US005095560A

United States Patent [19]

Volker

[11] Patent Number: 5,095,560

[45] Date of Patent: Mar. 17, 1992

[54] BED, PARTICULARLY BED FOR PERSONS WHO ARE SICK OR REQUIRE NURSING CARE

[75] Inventor: Heinrich Volker, Witten-Bommern, Fed. Rep. of Germany

[73] Assignee: Volker Mobelproduktionsgesellschaft mbH, Witten-Bommern, Fed. Rep. of Germany

[21] Appl. No.: 623,199

[22] Filed: Dec. 6, 1990

[30] Foreign Application Priority Data

Dec. 8, 1989 [DE] Fed. Rep. of Germany ..... 3940666
Dec. 8, 1989 [DE] Fed. Rep. of Germany ..... 8914490

[51] Int. Cl.[5] ..... A47C 41/00
[52] U.S. Cl. ..... 5/11; 5/611
[58] Field of Search ..... 5/11, 63, 64, 65; 280/43.24

[56] References Cited

U.S. PATENT DOCUMENTS

| | | | |
|---|---|---|---|
| 1,265,257 | 5/1918 | Schellinger | 5/64 |
| 1,378,096 | 5/1921 | Chat . | |
| 2,260,079 | 10/1941 | Lombardi et al. | 280/43.24 |
| 2,540,133 | 7/1947 | Miller . | |
| 2,590,382 | 3/1952 | Danielson | 280/43.24 |
| 2,592,166 | 4/1952 | McLean et al. | 5/11 X |
| 2,604,639 | 7/1952 | Killifer | 5/63 |
| 2,739,785 | 3/1956 | Gray | 5/63 X |
| 2,830,303 | 4/1958 | Sandock | 5/63 |
| 3,039,118 | 6/1962 | Hutt | 5/63 |
| 3,174,722 | 3/1965 | Alm | 5/63 X |
| 3,350,095 | 10/1967 | Clasen | 280/43.24 |
| 3,879,796 | 4/1975 | Whyte | 5/63 X |

FOREIGN PATENT DOCUMENTS

| | | |
|---|---|---|
| 544248 | 1/1956 | Belgium . |
| 1766522 | 6/1968 | Fed. Rep. of Germany . |
| 89071972 | 1/1990 | Fed. Rep. of Germany . |
| 167118 | 4/1934 | Switzerland . |
| 1117105 | 6/1965 | United Kingdom . |
| 1233521 | 1/1969 | United Kingdom . |

*Primary Examiner*—Renee S. Luebke
*Assistant Examiner*—Michael Milano
*Attorney, Agent, or Firm*—Morgan & Finnegan

[57] ABSTRACT

A bed, particularly a bed for persons who are sick or require nursing care, which comprises a bed frame, in which a preferably adjustable insert or frame for supporting a lying body is disposed, and a lifting frame, which carries the bed frame and is provided with a lifting device for lifting and lowering the bed frame. The lifting device comprises a plurality of foot supports, preferably four of such foot supports. The bed frame is provided with depending carrying supports, and a foot roller is provided at the bottom end of each carrying support. In order to improve the external appearance of the bed, the carrying supports and the foot rollers are disposed within the foot supports. The foot rollers, when lowered to a retracted position, protrude downwardly from the foot supports.

21 Claims, 3 Drawing Sheets

BED, PARTICULARLY BED FOR PERSONS WHO ARE SICK OR REQUIRE NURSING CARE

BACKGROUND OF THE INVENTION

1. Field of the Invention

This invention relates to a bed, and more particularly to a bed for persons who are sick or require nursing care, comprising a bed frame, in which a preferably adjustable insert or frame for supporting a lying body is disposed, and a lifting frame, which carries the bed frame and is provided with a lifting device for lifting and lowering the bed frame, wherein said lifting device comprises a plurality of foot supports, preferably four of such foot supports, and the bed frame is provided with depending carrying supports, wherein each of said carrying supports is provided at its bottom end with a foot roller.

2. Description of the Prior Art

A bed for nursing care is revealed in Swiss Patent Specification 167,118. That bed comprises a bed frame, in which an insert for supporting a lying person is arranged, and a lifting frame, which carries the bed frame and is provided with a lifting device for lifting and lowering the bed frame. The lifting frame comprises four foot supports. The bed frame is provided with depending carrying supports. A foot roller is provided at the lower end of each carrying support, specifically at the bottom end of an outwardly and downwardly extending bracket.

Belgian Patent Specification 544,248 discloses a similar bed, which comprises a bed frame and a lifting frame and in which foot rollers are connected to the bed frame and disposed beside the carrying supports.

British Patent Specification 1,233,521 and the corresponding German Patent Publication 17 66 522 show a bed that comprises a bed frame and a lifting frame and which comprises rollers connected to the lifting frame.

U.S. Pat. No. 1,375,096 discloses a bed in which the depending carrying supports are provided with foot rollers, which are disposed beside the carrying supports.

British Patent Specification 1,117,105 shows a bed in which foot rollers are connected to the bed frame and extensible foot supports are provided beside the foot rollers.

In the previously described beds, the foot rollers are always visible, and are always exposed to external influences.

It is thus an object of the present invention to improve the external appearance of a bed of the kind described first hereinbefore.

SUMMARY OF THE INVENTION

These and other objects are accomplished by providing a bed in accordance with the invention such that the carrying supports and the foot rollers are disposed within the foot supports, and that the foot rollers, in a lowered position, protrude downwardly from the foot supports. When the bed is upwardly extended, the foot rollers are disposed within the foot supports and are not visible, so that the external appearance of the bed is improved. The rollers are thus protected from external influences, so that they can be more easily kept clean, and potential damage due to a soiling of the rollers is prevented.

The rollers, when lowered, protrude downwardly from the foot supports, so that the bed can be rolled.

When the bed has been lowered, the rollers are hardly visible, because it is sufficient for them to protrude only a relatively short distance downwardly from the foot supports. Thus, the rollers continue to remain disposed within the foot supports, so that the rollers are hardly visible in a downwardly inclined direction of view. Moreover, the bed will be rolled only for a relatively short time. Thereafter, the bed will be raised so that the foot rollers are again entirely accommodated in the foot supports, and the bed is again stably supported by the foot supports.

A further advantage afforded by the selected arrangement resides in that the bed is on a lower level as it is rolled, so that the bed can be more easily maneuvered. When the bed is raised, and thereby stably supported by the foot supports, the bed will be relatively high, so that the patients can easily be nursed by the nursing staff. When the bed is stably supported, the bed (and the patient therein) are elevated to a convenient height for simple nursing care by the nursing staff. It will be apparent, then, that the bed can very well be manipulated.

Desirable further features are recited in the dependent claims.

It would be desirable to provide foot supports which are tubular or box-shaped in cross-section. The foot supports may be provided at their floor-engaging bottom edge with a pressure- and slip-resisting annular pad, which preferably consists of rubber of plastic.

The lifting frame is preferably adjustable in height by electromechanical or hydraulic means.

In accordance with a further desirable feature, those parts of the lifting means, preferably racks, pistons or cylinders, which are engageable by driving and adjusting means, are mounted on the carrying supports.

The carrying supports may be longer than the foot supports, so that the carrying supports, when lowered to a low position, will protrude a small distance downward from the foot supports so as to stand on the supporting surface. In other words, when the carrying supports have entirely been retracted into the foot supports, the foot rollers will downwardly protrude from the foot supports so that the bed can be rolled. As the carrying supports are upwardly extended, the foot rollers will be lifted from the floor and the bed will stand firmly and reliably on the foot supports. The carrying supports may be further extended for additional height adjustment of the bed. The foot supports are supported on a relatively large area, because the carrying supports inclusive of the foot rollers are surrounded by the foot supports. The carrying supports and foot supports are telescopically guided in each other.

It is preferable to provide only a central source of motive power, preferably an electric motor, for extending and retracting all carrying supports. The drive shafts may consist of a longitudinally extending main shaft and transverse shafts for driving the pinions. Within the basic concept of the invention, the source of motive power may alternatively consist of a hydraulic pump and associated individual lifting pistons for lifting/lowering the carrying supports.

The carrying supports may be provided with mounting and carrying heads, which serve for the connection to the bed frame and for providing a support on the lifting frame. In accordance with a further desirable feature, the bottom portions of the corner posts of the bed frame are so designed that said bottom portions can directly be placed onto and connected to the carrying heads of the carrying supports. In that case the bottom surfaces of the corner posts and the top surfaces of the carrying heads will be so designed that said surfaces are in register with and extend one into the other.

The longitudinal side bars of the bed frame may have approximately the same height as the longitudinal side bars of the lifting frame. This will afford the advantage that the longitudinal side bars of the bed frame conceal the upper portion of the lifting frame.

The central source of motive power for actuating all adjustable carrying supports in unison may be designed for individual actuation of the carrying supports, or actuating the carrying supports in pairs, or actuating all carrying supports. Differential locks or compensating pistons may be provided for that purpose.

The longitudinal side bars of the lifting frame are preferably provided with a safety guard for the central drive shaft and/or at least parts of the transverse shafts. This feature is particularly recommendable owing to considerations of safety. The guard may comprise, for example, a plate. The guard is desirably mounted on the longitudinal side bars of the lifting frame.

Each foot roller may be mounted so as to swivel about the longitudinal axis of its associated carrying support and to be rotatable about the axis of the roller. For that purpose the rollers are preferably mounted so that they can move in two different planes.

The foot supports may consist, at least in part, of cheek structures.

The bed in accordance with the invention has a pleasing appearance owing to the design provided in accordance with the invention and the desirable further features of the bed.

BRIEF DESCRIPTION OF THE DRAWINGS

The invention will be more fully described by way of reference to the appended drawings, in which.

DETAILED DESCRIPTION OF THE PREFERRED EMBODIMENTS

Illustrative embodiments of the invention are shown on the accompanying drawings.

Figure 1:
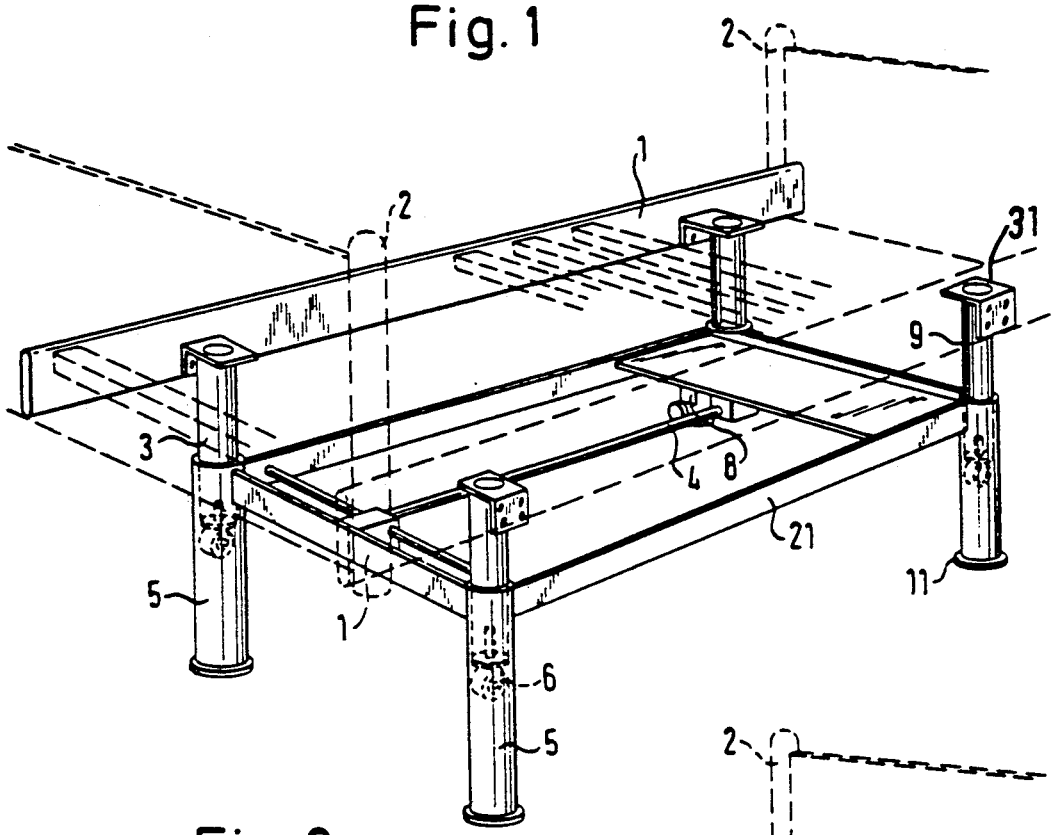
FIG. 1 is an elevational view of one embodiment of a bed according to the present invention, showing a bed for nursing care with extended carrying supports.

FIG. 1 shows one embodiment of a bed for nursing care. The bed, which can be used for various purposes, comprises a bed frame 1, which is provided at its ends with head and foot parts, and in which an insert (not shown) for supporting a lying person may be mounted. The head and foot parts, which are interconnected by longitudinal side bars, carry the corner posts 2.

The lifting frame 21 comprises a frame structure having transverse and longitudinal bars. Foot supports 5 are provided at all four corners, and may be tubular or box-shaped in cross-section but are not so limited. Carrying supports 3, which are connected to the bed frame 1, are telescopically guided in the foot supports 5 and are upwardly extensible. The carrying supports 3 are provided with racks 9 in mesh with drive pinion 10 (see FIG. 2). Carrying heads 31 are mounted on the carrying supports 3 and serve for the fixation of the bed frame 1 and for providing a support of bed frame 1 for or on the lifting frame 21. The carrying heads 31 limit the downward movement of the carrying supports 3, in that the carrying heads engage the top ends of the foot supports 5.

A movable and rotatable foot roller 6 is mounted at the bottom end of each carrying support 3. Each foot roller 6 is mounted, via means well known to those skilled in the art, so as to swivel about the longitudinal axis of its associated carrying support 3 and for a rotation about the transverse axis of the roller. Each foot support 5 is provided at its floor-engaging bottom edge with a pressure—and slip-resisting annular pad 11. The pad 11 may be made of rubber of plastic, but such a configuration is not necessarily so limited.

In a special embodiment (not shown in the drawings) the bottom ends of corner posts 2 are so designed, so that said bottom ends can directly be mounted on and/or connected to the carrying heads 31 of the carrying supports 3.

The height of the foot supports 5 may be devised so as to approximately correspond to a convenient height of the bed for sitting on and getting into the bed. The carrying supports 3 are configured longer than the foot supports 5, so that when the carrying supports 3 are in their retracted lower position (shown in FIG. 2) the foot rollers 6 will slightly protrude downwardly from the foot supports 5 so as to rest on the floor. In that position, the bed can be rolled.

A central source of motive power is provided for extending and retracting all carrying supports 3. The power source may consist of an electric motor 8, which drives the carrying supports 3 via a drive shaft arrangement 4. The drive shaft arrangement 4 comprises a longitudinal drive shaft and transverse drive shafts, with pinions 10 driven by the transverse shafts. The electric motor 8 and the drive shafts 4 are mounted in the frame structure of the lifting frame 21. The transverse shafts, shown in FIG. 2, operate the drive pinions 10, which are in mesh with racks 9 mounted on the carrying supports 3. It is apparent from FIG. 1 that the carrying supports 3 are telescopically guided in the foot supports 5 and are upwardly extended to raise the bed frame 1. During that movement the foot rollers 6 are lifted from the floor so that the bed then stands stably on the foot supports 5.

For the sake of safety the electric motor 8 may be covered by a guard 7. This guard 7 may consist, for example, of a plate or like configuration.

Figure 2:
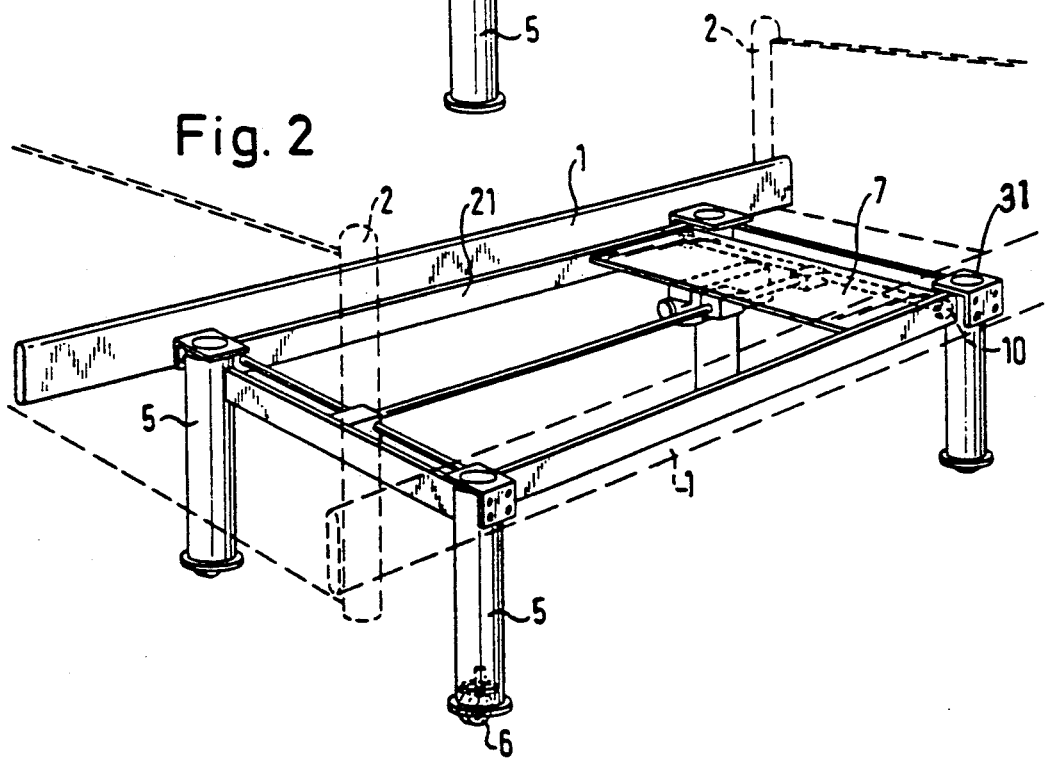
FIG. 2 is a side elevation view of the bed for nursing care shown in FIG. 1 but with the carrying supports retracted and with rollers standing on the supporting surface.

From FIG. 2 it is apparent that as the carrying supports 3 are retracted the foot supports 5 serve to guide the carrying supports 3, and the rollers 6 will slightly protrude from the lower end of the foot supports 5 so that the bed can be moved or swiveled about the rollers 6.

It is apparent from FIG. 1 that as the carrying supports 3 are raised, the foot rollers 6 enter the foot supports 5. Said foot supports 5 will then constitute rigid and reliable supporting legs for the bed. The foot supports 5 are provided at the floor-engaging bottom end of their tubular body with pressure - and slip-resisting annular pads 11, which may be made of rubber or plastic.

Conveniently, the longitudinal side bars of the bed frame 1 have about the same height as the longitudinal side bars of the lifting frame 21, as is apparent from FIG. 2, so that said longitudinal side bars of the bed frame 1 conceal the longitudinal side bars of the lifting frame 21.

When the carrying supports 3 have been extended, the bed body stands firmly and reliably on the foot supports 5, which surround the carrying supports 3. This is desirable not only for safety, but also when the nursing staff is making the bed because the nursing staff will then be prevented from inadvertently displacing the bed, such as by leaning on or applying pressure to the bed body. When the carrying supports 3 have been extended, the bed is stably supported on the foot supports 5, and the bed has a greater height than when the carrying supports 3 are retracted into the foot supports 5 for rolling the bed. Thus, the desired elevations are exactly achieved: when the bed stands stably, it has a relatively large height, so that the nursing staff can easily nurse the patients. As the bed is rolled, it is in a lower position, so that it can wisely be maneuvered.

The carrying supports 3 and foot supports 5 are guided one in the other so that the rollers 6 are protected within the foot supports 5. This will improve the appearance of the bed, and the rollers 6 will be protected from external influences and particularly from being soiled. The rollers 6 are covered by the foot supports 5, which effectively constitute outer tubes around the carrying supports 3.

Figure 3:
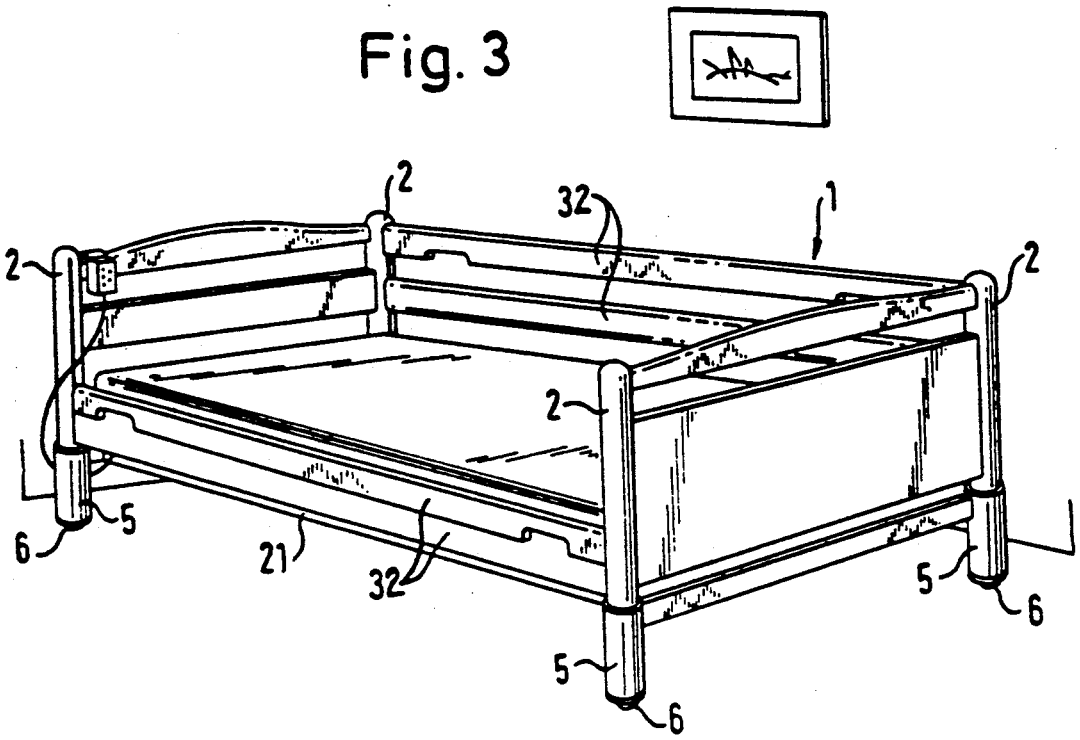
FIG. 3 shows a further embodiment of a bed according to the present invention, showing a modified bed for nursing care with retracted carrying supports.
Figure 4:
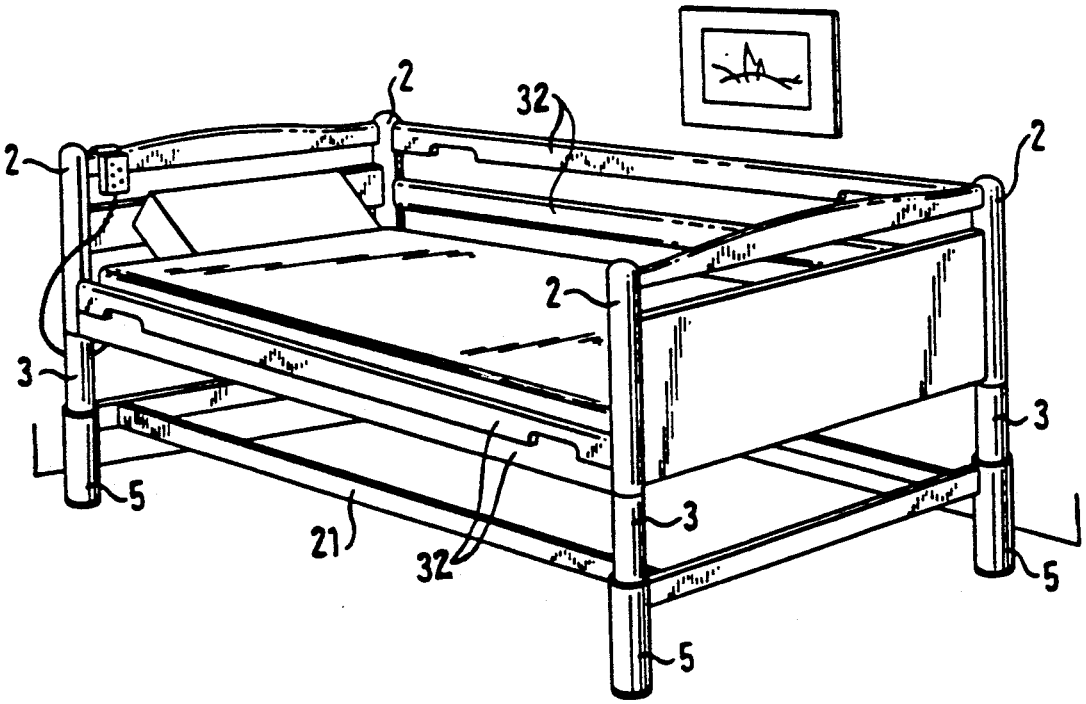
FIG. 4 illustrates the bed for nursing care shown in FIG. 3 with extended carrying supports.

FIGS. 3 and 4 show a modified embodiment of a bed according to the invention in which like parts are provided with like reference characters, and for this reason need not be described once more. The bed frame 1 comprises side bars 32, which are adjustable in height. The ends of the side bars 32 are slidably mounted in the corner posts 2.

In the position shown in FIG. 3, the carrying supports 3 have been retracted into the foot supports 5. In the position shown in FIG. 4, the carrying supports 3 are partly visible because they have been extended from the foot supports 3. When the carrying supports 3 have been retracted (FIG. 3), the foot rollers 6 protrude downwardly from the foot supports 5 and the bed can be rolled. As is apparent from FIG. 4, the carrying supports 3 are upwardly continued by the corner posts 2, so that the carrying supports 3 constitute bottom portions or continuations of the corner posts 2. That design is particularly space-saving and pleasing in appearance.

The bed shown in FIGS. 3 and 4 may comprise, for example, an electrically adjustable frame consisting of four hinged sections made of aluminum bars and provided with an integral neck support and with electrically operable means for an adjustment in height. In its lowermost position (shown in FIG. 3) the bed can move on rollers 6, which in that position protrude downwardly from the foot supports 5. The rollers 6 are concealed in the position in FIG. 4. In this position, the stability of the bed is increased by annular pads of plastic (not shown), as previously described with regard to FIGS. 1 & 2.

Figure 5:
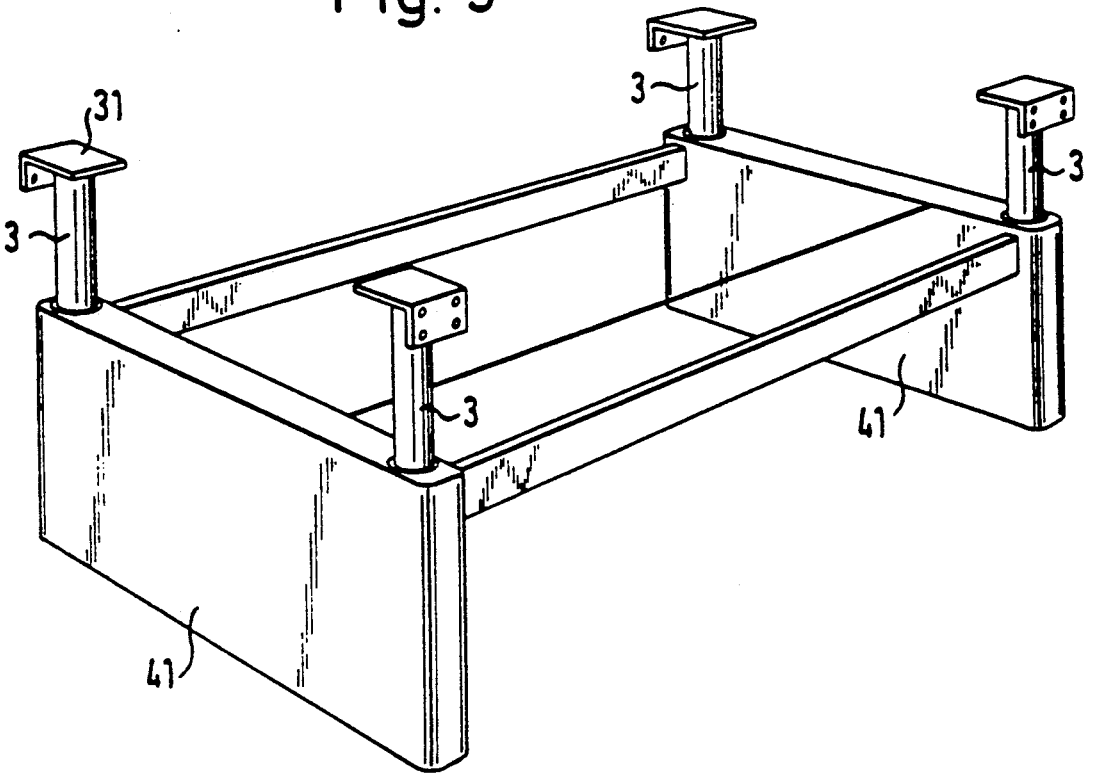
FIG. 5 illustrates another embodiment of a bed according to the present invention wherein a bed for nursing care is provided with a cheek structure and with the carrying supports retracted.
Figure 6:
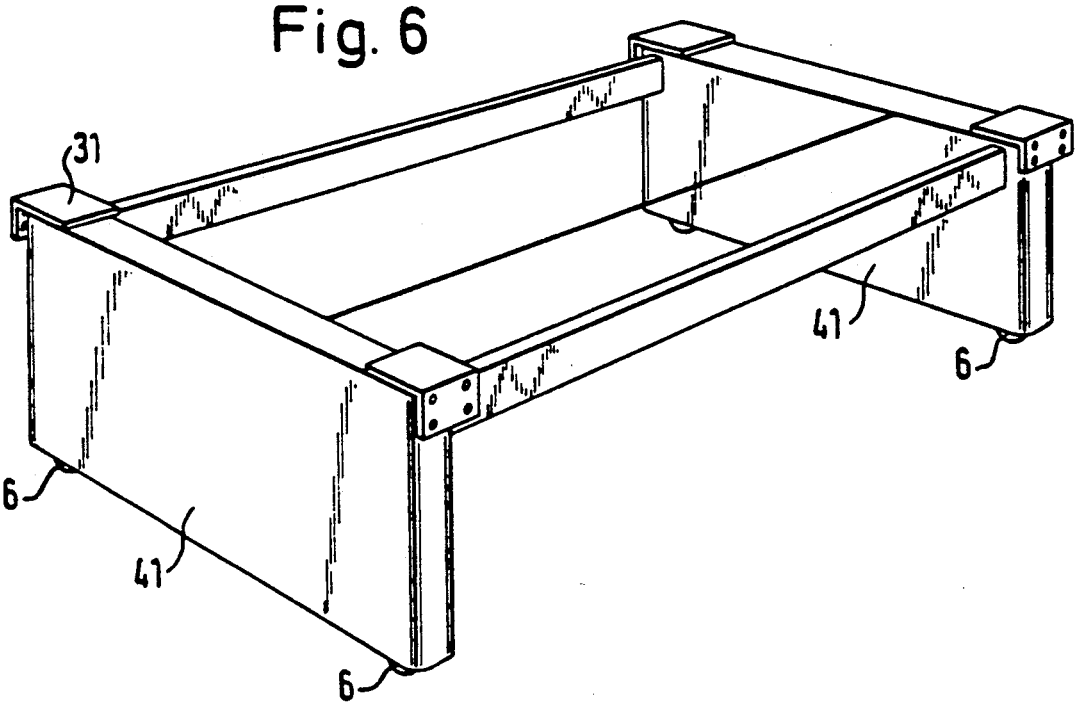
FIG. 6 illustrates the bed for nursing care shown in FIG. 5 with the carrying supports extended.

FIGS. 5 and 6 show a further modification of a bed according to the invention. Here, the bed has a cheek structure. The foot supports consist, at least in part, of cheeks 41. At each end of the bed, two foot supports are interconnected by a cheek 41. When the carrying supports 3 have been extended to the position shown in FIG. 5, the supports 3 protrude upwardly from the cheeks 41. When the carrying supports 3 have been retracted to the position shown in FIG. 6, they are entirely concealed in the foot supports (consisting of cheeks 41) and the rollers 6 protrude downwardly from the cheeks 41.

It will be apparent that other and further forms of the invention may be devised without departing from the spirit and scope of the appended claims, it being understood that this invention is not limited to the specific embodiments shown.

I claim:

1. A bed, particularly for sick persons or for persons requiring nursing care, comprising:
   - a bed frame having an insert for supporting a lying body,
   - a lifting frame for carrying the bed frame, and a lifting device for lifting and lowering the bed frame,
   - wherein said lifting frame comprises a plurality of foot supports, said foot supports having a floor engaging edge, and
   - the bed frame is provided with a plurality of carrying supports, wherein
   - each of said carrying supports is in engagement with said lifting device and each of said carrying supports has a foot roller at its bottom end,
   - characterized in that
   - the carrying supports are disposed within the foot supports, and
   - the foot rollers, in a lowered position, protrude downwardly from the floor engaging edge of the foot supports.

2. A bed according to claim 1, characterized in that the foot supports are tubular in cross-section.

3. A bed according to claim 1, characterized in that the foot supports are provided at their floor-engaging bottom edge with a pressure- and slip-resisting annular pad.

4. A bed according to claim 3, wherein said annular pad comprises rubber.

5. A bed according to claim 3, wherein said annular pad comprises plastic.

6. A bed according to claim 1, characterized in that the carrying supports are longer than the foot supports, so that the carrying supports will protrude downwardly from the floor engaging edge of the foot supports and stand on a supporting surface when the carrying supports have been lowered to a low position.

7. A bed according to claim 1, characterized in that the carrying supports further comprise mounting and carrying heads for connecting the carrying supports to the bed frame.

8. A bed according to claim 7, characterized in that the bed frame further comprises a plurality of corner posts having bottom portions, wherein the bottom portions of the corner posts are connected into the carrying heads of the carrying supports.

9. A bed according to claim 1, characterized in that the bed frame further comprise longitudinal side bars, and the lifting frame further comprise longitudinal side bars, wherein said side bars of the bed frame have approximately the same height as the longitudinal side bars of the lifting frame so that the longitudinal side bars of the bed frame conceals the upper portion of the lifting frame.

10. A bed according to claim 1, characterized in that each foot roller is mounted to swivel about the longitudinal axis of its associated carrying support and to be rotatable about the axis of the roller.

11. A bed according to claim 1, characterized in that the foot supports consist at least in part of cheek structures.

12. A bed according to claim 1, characterized in that the foot supports are box shaped in cross-section.

13. A bed according to claim 1, wherein said lifting device comprises hydraulic means.

14. A bed according to claim 1, wherein said lifting device comprises electromechanical means.

15. A bed according to claim 1, wherein said lifting device comprises:

a central power source for actuating said lifting device; and a drive arrangement for transferring power from said central power source to actuate said carrying supports, wherein said drive arrangement comprises a longitudinal drive shaft and transverse drive shafts having means for engagement with said carrying supports.

16. A bed according to claim 15, wherein said means for engagement with said carrying supports comprise racks mounted on said carrying supports for engaging pinions mounted onto the ends of said transverse drive shafts.

17. A bed according to claim 15, wherein said central power source comprises an electric motor.

18. A bed according to claim 17, characterized in that the electric motor actuates said lifting device to individually actuate the carrying supports.

19. A bed according to claim 17, characterized in that the electric motor actuates said lifting device to actuate the carrying supports in pairs.

20. A bed according to claim 17, characterized in that the electric motor actuates said lifting device to simultaneously actuate all the carrying supports.

21. A bed according to claim 17, characterized in that the lifting frame includes a safety guard for covering portions of the lifting device.

* * * * *